US005460161A

United States Patent [19]

Englehart et al.

[11] Patent Number: 5,460,161

[45] Date of Patent: Oct. 24, 1995

[54] CAMPFIRE WATER HEATING APPARATUS AND METHOD

[76] Inventors: Mark Englehart, R.R. 7 Site 1-B Compartment 18, Vernon B.C., Canada, V1T 7Z3; Rick Siemens, 6741 Foothills Drive, Vernon, British Columbia, Canada, V1T-8Z8

[21] Appl. No.: 83,715

[22] Filed: Jun. 25, 1993

[51] Int. Cl.[6] ..... F24H 1/00; F04F 1/06

[52] U.S. Cl. ..... 126/344; 417/209

[58] Field of Search ..... 417/208, 209; 126/344, 350 D, 250 R, 59, 29, 369, 9 R, 350 R; 237/60, 64

[56] References Cited

U.S. PATENT DOCUMENTS

| | | | |
|---|---|---|---|
| Re. 3,408 | 4/1869 | Prall | 417/208 |
| 44,542 | 10/1864 | McIntyre et al. . | |
| 84,948 | 12/1868 | Johnson | 417/209 |
| 111,542 | 2/1871 | Houghton . | |
| 127,592 | 6/1872 | Gates | 417/208 |
| 135,765 | 2/1873 | Bnock . | |
| 141,249 | 7/1873 | Wightman . | |
| 478,331 | 7/1892 | Joerden . | |
| 667,377 | 2/1901 | Waterhouse | 417/208 |
| 723,042 | 3/1903 | Schwerin | 417/478 |
| 874,991 | 12/1907 | Prien . | |
| 1,917,586 | 7/1933 | Huber . | |
| 2,143,755 | 1/1939 | Archer | 126/344 |
| 2,238,375 | 4/1941 | Simpson . | |
| 3,073,257 | 1/1963 | MacCracken | 417/209 |
| 3,158,104 | 11/1964 | Hutchinson | 417/478 X |
| 3,246,644 | 4/1966 | Peterson | 126/344 |
| 3,431,565 | 3/1969 | Nelson . | |
| 4,016,834 | 4/1977 | Jensen | 122/264 |
| 4,293,323 | 10/1981 | Cohen . | |
| 4,996,970 | 3/1991 | Legare | 126/9 R X |

FOREIGN PATENT DOCUMENTS

| | | | |
|---|---|---|---|
| 88490 | 1/1958 | Netherlands | 417/209 |

*Primary Examiner*—Carl D. Price

*Attorney, Agent, or Firm*—Robert B. Hughes; Hughes, Multer & Schacht

[57] ABSTRACT

An apparatus and method for heating and delivering water by use of a campfire, comprising drawing water from a first kettle through a supply hose to a heat exchanger that is placed in the campfire. The water in the heat exchanger boils to cause a discharge of water upwardly through a delivery tube to a collecting kettle, after which the pressure in the heat exchanger drops to cause a further supply of water to be drawn from the supply kettle to the heat exchanger. Thus, quantities of hot water (e.g. a cupful in each quantity) can be discharged at short intervals (45 seconds or so) to supply cups of hot water for a beverage such as coffee, tea, etc. Other embodiments are arranged to draw water from a lower location up to the heat exchanger and then pump the water upwardly to a storage container.

13 Claims, 5 Drawing Sheets

30d
28d
56d
146
92d
124d
122d
136
138
134
132
140
10d
96d
16d
34d
48d
20d
12d
131
126d
94d
90d
60d
64d
104d
130

CAMPFIRE WATER HEATING APPARATUS AND METHOD

BACKGROUND OF THE INVENTION

A. Field of the Invention

The present invention relates to an apparatus and method for heating a liquid, and also delivery of said liquid. More particularly this invention is adapted to be used in circumstances where certain modern conveniences are not present, and the heat source is one that is not especially arranged for the convenient heating of a liquid, such as in heating water by means of a campfire or the like, or in a fireplace in a recreational cabin.

Background Art

Many (if not most) campers, backpackers, Boy Scouts, Girl Scouts, or others who enjoy outdoor living have had the experience of heating water over an outdoor fire, such as a campfire. In fact, one of the attractions of such outdoor activities is to forego some of the conveniences of a modern kitchen and "get back to basics", such as cooking over an open fire, and also heating water for various purposes (e.g. cooking food, preparing a cup of coffee or some other beverage, hot water for washing, etc.).

One method of heating water over a campfire is to place the water in a kettle and position the kettle over or adjacent to the flames of the fire to be heated thereby. Sometimes a wire metal grate is provided to extend from side supports across the fire. In other instances, a metal rod or the like is positioned over the fire and the kettle is suspended by a U shaped handle from the rod. Sometimes a metal pot having a laterally extending handle is placed on a couple of burning logs near the periphery of the fire so that it is supported close enough to the fire to warm the water, and yet the handle is accessible to be grasped with a glove and move the pot away from the fire to pour the water.

In a typical camping situation where water is being heated, there is also the question of timing. For example, when a backpacker has arrived at a campsite and has started a small wood fire in the brisk evening air, often one of the first things that a person wants is a cup or two of a hot beverage (tea, coffee, hot chocolate, etc.). At a later time, a quantity of hot water is often needed to cook the meal. At the conclusion of the meal, an additional amount of hot water will be useful in properly cleaning the cooking and eating utensils. This often requires moving the kettle or pot over the fire, then off the fire, etc.

Further, in setting up camp, there are often a number of tasks to be performed, such as setting up a tent, getting the air mattresses and sleeping bags in place, finding a nearby tree limb or the like that is suitable for hoisting a backpack to a suitable location to be away from animals who might get into the backpack at night, getting water from the nearby stream, gathering some firewood, etc. Admittedly, one of the pleasurable challenges for the camper or outdoorsman is to perform these tasks without the conveniences of a modern kitchen. Even so, quite often human ingenuity is challenged to perform these tasks effectively, while still remaining within the more natural environment without complex modern conveniences, and shunning the modern "gadgets".

In other instances, people seek a more natural environment, without all the conveniences and complexities of a modern home, by setting up a more permanent campsite or possibly spending a number of days in a vacation cabin where there is no central heating, no electricity, and little or no plumbing. Usually such a cabin (or possibly a tent set up as a more permanent campsite) would be located near a source of fresh water, such as a nearby stream or lake. The water needed for drinking, cooking, washing the cooking appliances and utensils, and also for personal hygiene, is carried in pails or other containers to the cabin or tent. Again, the water is heated over an outdoor campfire, over a fire in an indoor fireplace, or possibly over a wood burning stove.

In these circumstances also, while the intent is to preserve the more natural living environment, a person will still sometimes seek more imaginative solutions for accomplishing these chores. This is particularly true where the solution itself does not depend upon the sophistication of present day technology incorporated in a modern kitchen or in the plumbing system of a modern home.

A search of the patent literature has disclosed a number of patents relating to heating water from some source such as a stove, furnace or the like. These are the following.

U.S. Pat. No. 3,431,565 (Nelson) shows a portable shower where a mixture of hot and cold water can be delivered to the shower nozzle head 16. Water is drawn from a container 20 by means of a pump 24 and delivered to a junction 32 having two outlets, namely the pipes 34 and 36. The unheated water is delivered through the conduit 34 to the valve 18, while the conduit 36 leads the water through a heating unit 38. This heating unit comprises a coiled conduit positioned over a stove which causes the water passing through the conduit to be heated and then delivered to the pipe 40 and then to the valve 18. The valve 18 on the shower head is adjusted to get the proper blend of hot and cold water. The pump 24 is electrically operated, and as shown herein has a set of connecting leads that are connected to the automobile battery.

The remaining patents relate primarily to water heating devices at more or less fixed locations, and water is drawn from a tank to pass through a heat exchanger, after which it is returned to the tank. It appears that most of these depend upon the recirculation of the water by convection current (where the heated water is less dense and thus causes the flow) from the container through a heat exchanger of some sort exposed to a source of heat, and then back to a tank, more or less in a continuous process. In one of these, the water is heated in the heat exchanger to form steam that in turn passes back to the tank. These patents are the following.

U.S. Pat. No. 44,542 (McIntyre et al) shows a water heating device where there is a water tank "a" having a pipe "c" which leads into a heat exchange pipe section with a coil. The opposite end of the pipe coil extends through an upper pipe back to the tank. The coil is placed in the flu of a stove and heated by the same so as to heat the water that passes therethrough. The circulation of the water is presumably cause by the heat of the water rising in the coil, and with the cold water flowing into the coil through the lower pipe.

U.S. Pat. No. 478,331 (Joerden) shows a cooker where a pipe extends from a water containing vessel into the flu of a stove, thence upwardly and thence back into the water in the container. The heating of the water in the pipe section in the flu causes steam to pass into the contained water and heat the same for cooking.

U.S. Pat. No. 874,991 (Prien) shows a water heater that circulates the water in the tank through a heat exchanger in a furnace. The water passes from the tank through the pipe 13 and exits from the pipe 10 into a concentric outer pipe 9 which is in the furnace and acts as a heat exchanger. Then the water passes upwardly through the pipe 15 into the tank 14, to be discharged as hot water from the pipe 17.

U.S. Pat. No. 1,917,586 (Huber) shows a water heater where cold water is directed through the pipe 16 into the tank 4, and the water flows through the tank 4 through the pipe 14 into a heating drum 5. This drum 5 is positioned above a heating element 1. Then the water from the drum 5 flows through a return pipe 13 back into the tank 4 and then it's directed through a pipe 17 as hot water.

U.S. Pat. No. 2,238,375 (Simpson) shows a water heater to be used in connection with a range (i.e. a stove). There is a water tank 16 which surrounds the flu of the stove so that water in the tank is heated. In FIG. 7 a heat exchange coil is positioned in the flu.

U.S. Pat. No. 4,293,323 (Cohen) shows a heat recovery system that has a heat exchanger 10 placed in a water tank. This is used in combination with a refrigeration system and the high temperature compressed refrigerant is directed through an inner tube that is concentrically positioned within an outer tube 12. Heat exchange takes place through the tube 12 with the surrounding water.

SUMMARY OF THE INVENTION

The present invention relates to a method and apparatus for heating a liquid having a liquid form at a lower temperature and a gaseous form at a higher temperature, such as water, and more particularly to the heating liquid in conjunction with moving the liquid to the heating area from a supply location, and also moving the liquid or water from the heating location to a delivery or collecting location.

In the method of the present invention, there is first provided a liquid heat exchange device having a containing section defining a liquid chamber, an inlet leading into the cheer, and also an outlet leading from the chamber.

The liquid to be heated is moved from a supply location through supply tube means to the inlet and into the chamber. Heat energy is delivered to the cheer at a rate sufficient to cause the liquid to go at least partially into a gaseous state in the chamber in a manner to force a quantity of heated liquid in one of a gaseous state, a liquid state or a state that is both gaseous and liquid from the chamber to the outlet, into delivery tube means and to a delivery location.

Then additional liquid to be heated is moved from the supply location to the chamber where said additional liquid is heated to cause a second quantity of the liquid to be delivered to the delivery location as described above.

In a preferred form, the liquid to be heated and delivered is water. Also, in a typical application of the method of the present invention, the heat is derived from a source such as a campfire, a fire in a fireplace, or a similar heat source not specifically arranged for a water heating, water moving and water storage.

In at least one embodiment, the liquid is delivered from the supply location by operating said supply tube means as a siphon. Also, in at least one preferred embodiment, there is provided check valve means in the supply tube means to prevent liquid from flowing from the heat exchange device back to the supply location. Also, in a preferred form, the check valve means for preventing the back flow of liquid is utilized in conjunction with a pump to pump liquid through the supply tube means to start a siphon action and/or to prime the system. Further in certain preferred embodiments the liquid is drawn into the chamber by delivering cooler liquid into the chamber to cause condensation of steam or vapor and thus a lower pressure to cause more liquid to be drawn into the chamber.

In one embodiment, the heat exchange device is arranged so that the inlet is at a first end location in the chamber, and the outlet is at a second end location in the chamber, such that liquid from the supply location is delivered to said chamber at the first end location, and exits from the chamber at a second end location.

Specifically the liquid is delivered into the first end location through conduit means within said chamber and discharged from the conduit means at the second end location in the chamber, and the outlet means is located at the first end location in the chamber so that the outflow of liquid is at the first end location.

In another embodiment, the liquid is delivered into the first end location of the chamber through conduit means within the chamber and discharged from the conduit means into the chamber at the second end location. The outlet means is located at said second end location of the chamber so that outflow of the liquid from said chamber into said outlet means is at said second end location.

Also, in one preferred form, there is provided check valve means in the delivery tube means to prevent reverse flow in the delivery tube means back to said chamber. With reverse flow in said delivery tube being prevented, one embodiment of the method further comprises adding additional liquid from the supply location after liquid is discharged through the delivery tube means to cause condensation in said chamber to in turn cause liquid to be moved into the chamber and into the delivery tube means up to the check valve.

In another arrangement of the present invention, the supply location is at a lower elevation than that of the liquid chamber of the heat exchange device. The liquid is caused to be delivered from the supply location to the chamber by creating a pressure level in the chamber sufficiently lower than ambient pressure at the supply location to cause liquid to flow upwardly through the supply tube to the chamber. One specific means of accomplishing this is that liquid at the supply location is moved into pressure tank means and delivered from the pressure tank means through the supply tube means to the chamber. After liquid in the chamber is heated and moved from the chamber, a reduction of pressure in the chamber draws liquid from the pressure tank means into the chamber to create gaseous condensations and cause liquid to move through the supply tube means to said chamber.

In another arrangement of the method of the present invention, heated liquid from the chamber is delivered through the delivery tube means at least partly in a gaseous state to pump tank means to cause liquid in the pump tank means to be moved to a storage location. The method further comprises delivering additional liquid into one of said chamber and said pump tank means to cause condensation to draw further liquid from the supply location to the chamber and to the pump tank means.

Also in a preferred form, there is provided pressure tank means having a quantity of condensing liquid therein with the pressure tank means being operatively connected to the pump tank means. At least a portion of the condensing liquid is directed from the pressure tank means into the pump tank means subsequent to discharge of liquid from the pump tank means to cause condensation of gaseous liquid and thus cause additional liquid to be moved from the supply location to the chamber and to the pump tank means. In another embodiment the condensing liquid is directed from the pressure tank means into the chamber to cause condensation and liquid to be moved into the chamber and into the pump tank means.

In a preferred form, the liquid heat exchange device is a portable device, and the liquid is water. The method further comprises delivering heat energy to the chamber by placing the liquid heat exchange device with water therein in proximity with flame created by an open fire, such as a campfire or a fire in a fireplace.

The apparatus of the present invention comprises a heat exchange pump device comprising a thermally conductive containing section defining a water heat exchange chamber of a predetermined volume. The apparatus has a water inlet and a water outlet, supply tube means and check valve means.

The apparatus is characterized in that the predetermined volume in the chamber is such, relative to the heat exchange surface of the containing section and the thermal conductivity of the containing section, that sufficient heat is created to generate steam in the chamber to increase pressure in the chamber to cause flow of water from the chamber through the delivery tube means and out said delivery tube means at said delivery location, and then create a reduced pressure in the chamber to cause a flow of water from the supply location through the supply tube means into the chamber, where additional water in said chamber is again heated to deliver a quantity of liquid through said delivery tube means.

Other features of the present invention will become apparent from the following detailed description.

DESCRIPTION OF THE PREFERRED EMBODIMENTS

Figure 1:
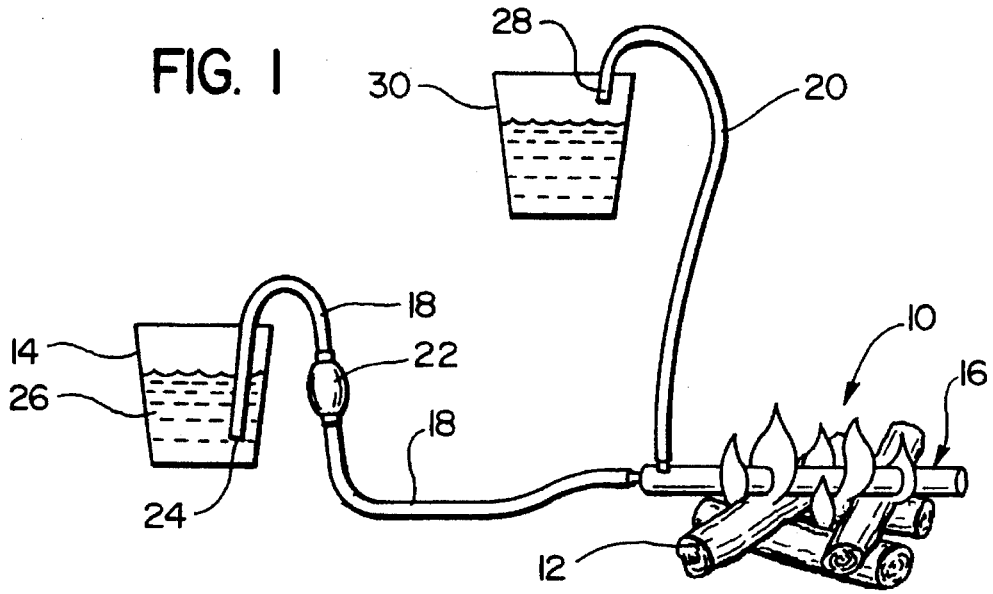
FIG. 1 is a somewhat schematic view illustrating a first embodiment of the present invention being used in conjunction with a campfire.

The first embodiment of the present invention will now be described with reference to FIGS. 1 through 3. In FIG. 1, the apparatus 10 of the present invention is shown operating in one of its intended environments, namely at a campsite where a wood burning campfire 12 has been started and is just beginning to burn somewhat briskly. Further, a pail or kettle of water 14 has been obtained from a nearby stream. It is now desired to heat the water in the kettle 14 by means of the fire 12. The apparatus 10 of this first embodiment is especially designed for this situation.

This first embodiment 10 comprises a cylindrical elongate heat exchanger/pump 16 that is connected to a supply tube 18 and a delivery tube 20. Near the inlet end of the supply tube 18 there is provided a siphon pump 22, and the inlet end 24 of the supply tube is immersed in the water 26 in the pail 14. The outlet end 28 of the delivery tube 20 is positioned to discharge into a second collecting pail 30.

The heat exchanger/pump 16 comprises a metal container 32 defining a heating/condensing chamber 34. The container 32 comprises an elongate cylindrical side wall 35 which is closed by opposite end walls 36 and 38. The near end portion 38 of the container 32 has connected thereto first and second connectors or nipples 40 and 42 to which are attached the ends 44 and 46 of the tubes 18 and 20, respectively. The inlet nipple 40 is connected to an inside supply metal conduit 48 that extends from the wall 38 to its end portion 50 that is spaced a short distance from the opposite end wall 36. The entire heat exchanger/pump 16 is desirably made from copper or some other material that has good thermal conductivity and is corrosion resistant.

Figure 3:
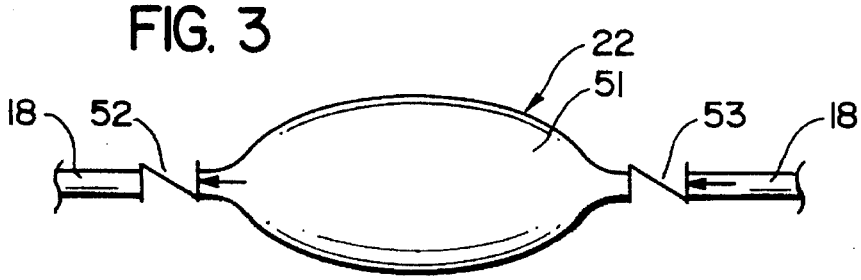
FIG. 3 is a schematic view of the siphon pump utilized in the first embodiment.

The siphon pump 22 is or may be of conventional design, and as shown schematically in FIG. 3 comprises a rubber squeeze bulb 51 having upstream and downstream check valves 52 and 53, respectively. It can be seen that when the bulb 51 is squeezed, it delivers the fluid therein outwardly through the valve 53, and when the bulb 51 is released, it expands to draw in liquid through the check valve 52. Thus, it is apparent that by squeezing the bulb 51 several times and then releasing it, water is drawn from the pail 14 into the tube inlet 24 and begins to flow through the bulb 51 and down through the supply tube 18. At such time as the water in the supply tube 18 drops below the level of the water 26, the tube 18 begins acting as a siphon and draws water into the remaining portion of the tube 18 so that it then flows through the inside pipe 48 and out the outlet 50 to fill the chamber 34. Then the water will continue to flow up the delivery tube 20 until it reaches a water level equal to that of the water 26 in the bucket 14.

To describe the operation of this first embodiment and at the same time to demonstrate one of the rather striking advantages of the present invention, let us take the situation where there are several backpackers who have arrived in the late afternoon/early evening at a campsite. The campers begin to unpack their gear, set up a tent, etc. One person immediately begins building a campfire, and another travels to a nearby stream to fill one or more kettles with water and bring these back to the campsite. The temperature of the early evening air has begun to drop somewhat, and the first order of business is to obtain several cups of hot water so that a warm beverage (tea, coffee or whatever) can be provided.

Instead of putting a kettle of water over the campfire to obtain hot water, the person responsible for heating the water simply places the inlet end 24 of the tube 18 into the water 26 in the pail 14 and pumps the siphon pump several times to start the water flowing into the tube 18 and into the heat exchanger/pump 16. About five or ten seconds later a moderate amount of water has filled the heat exchanger/pump 16, which is then placed into the open fire 12. In this particular instance, the pail 14 is at a relatively lower location only a foot or two above the location of the heat exchanger/pump 16. On the assumption that the wood fire 12 has begun to burn fairly briskly, within about two minutes or so, the water in the chamber 34 has been brought to the boiling point, and it is noted that the water in the delivery tube 20 begins to rise. Then a few seconds later, a quantity of water begins traveling more rapidly up the tube 20 and is discharged out the tube outlet 28. If the tubes 18 and 20 are clear plastic tubes, the flow of water can be observed, and when the person sees that the water is beginning to flow up the tube 20, the person simply places his drinking cup below the outlet 28 and a small quantity of water (i.e. about a cupful), heated close to the boiling point, is discharged into the cup. As the last portion of this water is discharged from the outlet end 28 there is a short discharge of steam for a second or two from the tube outlet 28. (The very first portion of the water that is delivered in the first heating cycle may be at a lower temperature since it flows through the heat exchanger/pump 16 rather quickly to fill the lower part of the tube 20).

Then immediately, there is a rapid inflow of water from the pail, through the supply tube 18 and into the chamber 34. Very shortly thereafter, it can be seen from the flow into the lower part of the tube 20 that the chamber 34 is substantially filled with water. About forty five seconds later, the water in the chamber 34 is heated to the boiling point and it is discharged through the delivery tube outlet 28, this being enough water for a second cup of hot water. Thus, at forty five second intervals, hot cups of water are provided for the campers.

It should be noted that the operating sequence noted above is one personally observed by the applicant's attorney who is preparing this present patent application. This was done with a small outdoor campfire and with the apparatus 10, as described above.

With the immediate requirement of promptly supplying several cups of hot beverage having been met, more hot water will likely be required for cooking, and later for washing the cooking and eating utensils. Then possibly at a later time there may be a quantity of warm water desired for personal hygiene. One option is that hot water could continue to be collected in the kettle 30. When enough water has been collected, then the heat exchanger/pump 16 is simply removed from the campfire 12. On the other hand, if it is simply desired to maintain a quantity of hot water, without immediate need of the same, then the outlet end 28 of the delivery tube 20 could be inserted into the same kettle 14 from which the supply tube is drawing water. In this instance, water would simply continue to be circulated from the kettle 14 through the heat exchanger/pump 16 and back to the kettle 14. As the water becomes hotter, the heating time to bring the water in the chamber 34 to a boiling point would be shortened, and the pumping cycles would accordingly become shorter. When the water in the pail 14 has reached an adequately high temperature, the heat exchanger/pump 16 is removed from the campfire 12.

At this point, it should be pointed out that the present invention 10 is functioning not only as a heat exchanger to heat the water, but also a delivery system where cold water is taken from the supply location and the hot water is conveniently delivered to a location away from the fire. Further the heat exchanger/pump 16, as its name implies, pumps the heated water to a higher location.

Let us now discuss at least briefly what is occurring during this heating and pumping cycle described above. As explained previously herein, when the siphon pump 22 is operated to start the siphon flow in the supply tube 18, the water fills the chamber 34 and flows into the tube 20 to rise to the level of the water 26 in the kettle 14. With the heat exchanger/pump 16 positioned in the campfire 12, the temperature of the water in the chamber 34 rises until it reaches the boiling point.

An analysis of the operation of the heat exchange/pump 16 indicates that the rate of transfer of heat energy from the campfire 12 through the wall of the container 32 of the heat exchanger/pump 16 is sufficiently great, relative to the location and cross sectional area of the outlet nipple 42 so that as steam is formed in the chamber 34, there develops an expanding body of hot water comprised of the liquid water at boiling temperature and small steam bubbles forming in the water. This causes the water in the chamber 34 to expand and start passing outwardly through the nipple 42 and into the tube 20. The check valves in the siphon pump 22 prevents back flow in the supply tube 18. The water continues to be discharged from the chamber 34 into the tube 20 to discharge a quantity of hot water from the end 28 of the delivery tube 20, until the water level in the chamber 34 drops until only steam begins passing into the tube 20.

When the last portion of the water is emitted from the delivery tube 20, then there is a pressure drop in the chamber 34 and cooler water begins flowing by gravity (with the siphon action) from the supply tube 18 through the inside supply section tube 48 into the chamber 34. This immediately begins to cool the interior of the chamber 34 to condense the steam in the chamber 34, so that yet more of the cooler water flows inwardly through the tube section 48 until the chamber 34 again becomes filled. Then the same cycle is repeated.

Figure 2:
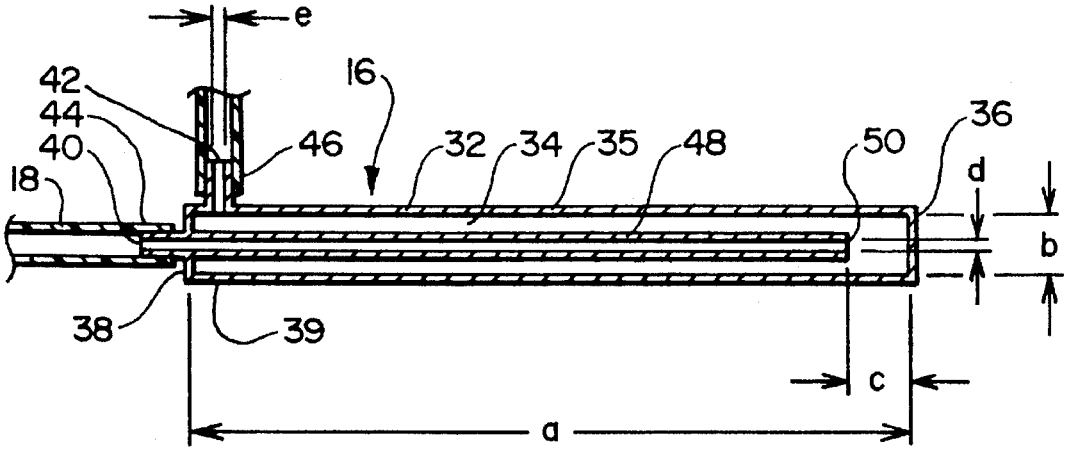
FIG. 2 is a longitudinal sectional view of the heat exchange/pump apparatus of the first embodiment of FIG. 1, showing dimensions of the same.

With regard to the sizing of the components of the first embodiment 10, with reference to FIG. 2, in one preferred configuration, (the operation of which is described above), the length "a" of the container 32 was twenty four inches, and the inside diameter (indicated at "b") was three quarter inches. The distance "c" of the end wall 36 to the discharge end 50 of the tube 48 was one inch. The side wall 35 of the container 32 was made of copper having a thickness dimension of 3/64 inch. The inside diameter "d" of the inside conduit 48 was 9/32 inch. The inside diameter "e" of the outlet nipple 42 was 9/32 inch. The inside diameter of the inlet nipple 40 was the same as the inside diameter of the inner conduit 48. The total volume of the chamber 34 (including the tube 48) was 270 milliliters.

It is to be recognized, of course, that these dimensions can be changed, depending upon the requirements. A smaller backpackers model of the apparatus was constructed where the total lengthwise dimension "a" was only fifteen inches, and the inside diameter "b" was three quarter inches.

Figure 4:
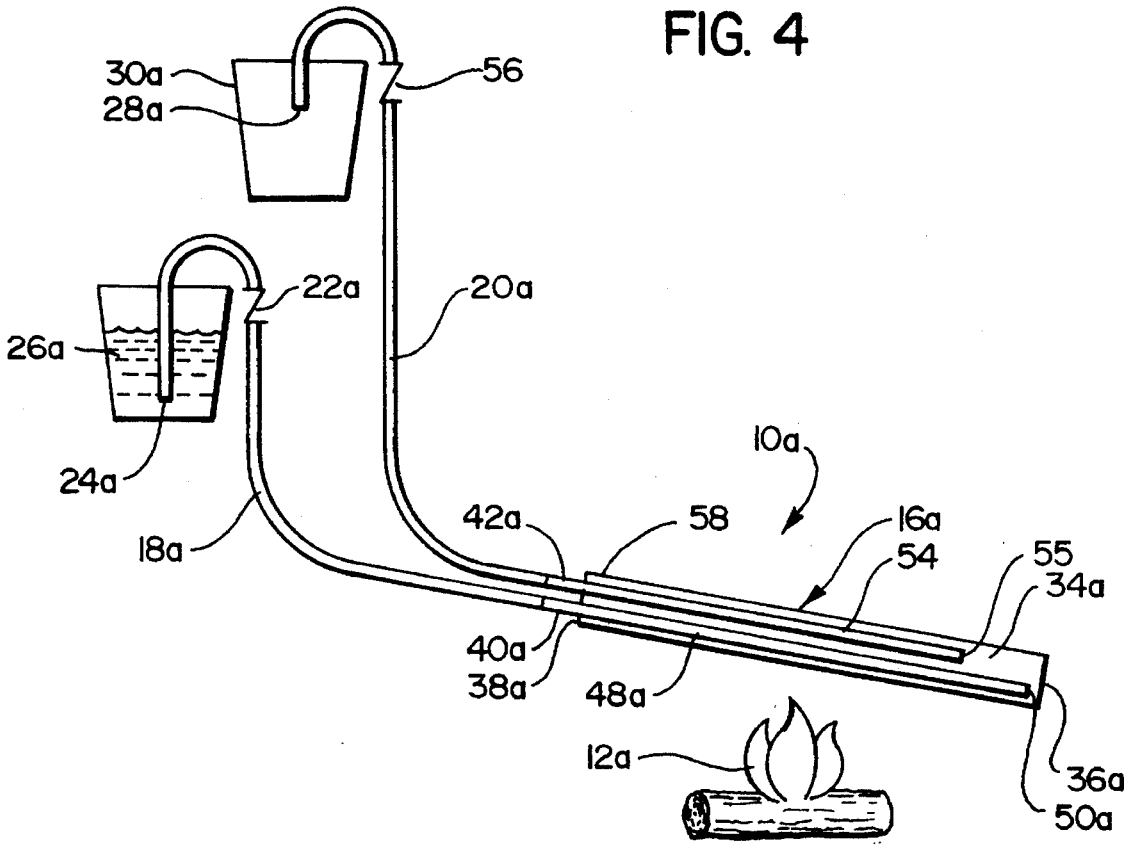
FIG. 4 is a view similar to FIG. 1, but showing a second embodiment of the present invention, also being used in conjunction with a heat source such as a campfire.

FIG. 4 shows a second embodiment of the present invention. Components of the second embodiment which are similar to those of the first embodiment will be given like numerical designations with an "a" suffix distinguishing those of the second embodiment.

This second embodiment **10*a* has the basic components of the first embodiment, namely the heat exchanger/pump 16*a*, the supply tube 18*a*, the delivery tube 20*a* and also the siphon/check valve 22*a*. Further, the heat exchanger/pump 16*a* also has the supply conduit 48*a* leading from the supply line 18*a* and extending to the far end of the chamber 34*a* adjacent to the end wall 36*a***.

However, the heat exchanger/pump **16*a* differs in that there is a second inside conduit 54 connecting to the delivery nipple or section 42*a* and having its opposite end 55 spaced a short distance from the end wall 36*a*. A further difference is that a check valve 56 is provided in the delivery tube 20*a***.

The operation of this second embodiment **10*a* is rather similar to that of the first embodiment, but with some differences. As in the first embodiment, the inlet end 24a of the supply tube 18a is immersed in the water supply 26a, and the outlet end 28a of the delivery tube 20a is placed in the collecting container 30a. The heat exchanger/pump 16a is placed in the campfire, and as the water in the chamber 34a is brought to a boiling point, the water is delivered into the intake end 55 of the inside delivery conduit 54, into the supply tube 20a, and out the end 28a of the tube 20a**.

The addition of the inside delivery conduit 54 affects the operation. In using the apparatus of this second embodiment, the person would normally position the heat exchanger/pump 16a so that the far end wall 36a is positioned lower than the near end wall 38a.

As in the first embodiment, when the water in the chamber 34a reaches the boiling point, bubbles begin forming especially in those areas of the water in the chamber 34a where there is more rapid transfer of heat energy. The presence of the bubbles causes the overall volume of the water to increase, thus forcing water into the end 55 of the conduit 54 and into the delivery tube 20. However, it will be noted that with the heat exchanger/pump 16a being slanted, the delivery inlet 55 is at a relatively low location in the chamber 34a. The steam bubbles that are rising from the boiling water in the chamber 34a will tend to collect more in the upper area 58 adjacent the near end (i.e. nearer the end wall 38a) of the chamber 34a. As the water level continues to drop in the chamber 34a as more water is pushed into the conduit 54 and up the tube 20a, the water level reaches the level of the delivery tube inlet 55, at which time substantially only steam begins flowing out the tube 20a. As the nearly pure steam moves into the tube 20a and begins forcing the water out of the tube 20a, assuming the outlet end 28a of the tube 20a is at a higher level than the chamber 34, the further the steam moves up the tube 20a, the less is the back pressure produced by the remaining water in the upper portion of the tube 20a. As the water moves further upwardly, the back pressure starts to decrease slightly. This causes the flow of steam to accelerate up the tube 20a until it blows out the tube end 28a.

As soon as the steam passes out of the tube end 28a, there is an abrupt pressure drop in the tube 20a, and the pressure in the chamber 34a drops to near atmospheric. Since there is already cooler water in the supply tube 18a, the immediate effect is that the water in the tube 18a begins to flow into and out the end 50a of the interior supply conduit 48a. This causes the steam in the chamber 34a to condense and there is an immediate drop in pressure and temperature in the chamber 34a.

Now we turn our attention to the effect of the check valve 56. Since the check valve 56 prevents reverse flow down the tube 20a, and since at this time there is essentially only steam in the tube 20a, when the steam in the chamber 34a and inside the section of the tube 20a below the check valve 56 condenses, there is actually a drop of pressure in the chamber 34a to below atmospheric. The effect of this is to accelerate the flow of water through the tube 18a and the inside supply conduit 48a, with this water flowing into the chamber 34a and upwardly through the tube 20a to the level of the check valve 56. When this happens, further water flow stops, and the cooler water now in the chamber 34a begins to increase in temperature as heat energy is supplied by the fire 12a through the walls of the heat exchanger/pump 16a.

The new supply of cooler water that flows into and through the chamber 34a to become positioned in the delivery tube 20a up to the level of the check valve 56 will have become heated to some extent. It will then begin to cool, with the rate of cooling depending upon the thermal characteristics of the delivery tube 20a. Then when the water in the chamber 34a reaches the boiling point, there is the same formation of steam and flow of hot water out the chamber 34a and into the tube 20a to deliver water into the container 30a.

At this point, to appreciate some of the features of this second embodiment, it would be helpful to review further this above described pumping action of this second embodiment 10a. As shown in this second embodiment 10a, the check valve 56a is at a rather high location near the end 28a of the delivery tube 20a. Therefore, after the discharge cycle where steam has passed upwardly through the delivery tube 20a and beyond the check valve 56, not only is a large portion of the heating chamber 34a emptied of water, but also the interior of the delivery tube 20a is also emptied of water. The tube 20a is desirably constructed to have sufficient strength to either withstand the atmospheric pressure and not collapse when its interior pressure drops substantially below atmospheric, or at least have sufficient strength in terms of resilience in returning to its full circular cross sectional configuration to cause water to be drawn upwardly therein after the completion of the discharge of water from the tube 20a and as cooler water flows into the chamber 34a. As described above, the water from the pail 26a will be drawn into the chamber 34a, to fill the chamber 34a and also to flow upwardly through the tube 20a up to the location of the check valve 56.

On the next heat exchange pumping cycle of the apparatus 10a, there will be pumped upwardly into the collecting container 30 not only the volume of water that would normally be discharged from the chamber 34a, but also the water which on the previous cycle had been drawn into the portion of the tube 20a below the check valve 56. Further, as indicated above, the initial portion of water that flows through the supply line 18a would pass through the containing chamber 34a and upwardly through the tube 20a so as to have a substantially shorter time period within the chamber 34a so as to absorb less heat energy.

It becomes apparent that in the overall operation of this second embodiment, a greater volume of water can be pumped to a higher level relative to the heat energy taken into the heat exchanger/pump 16a. On the other hand, the overall average temperature of the water (i.e. the total of the water that is drawn quickly through the heat exchange chamber 34a and into the tube 20a, and also the water which remains in the chamber 34a during the full heating cycle) will be somewhat lower. This arrangement would be more useful if the purpose is to pump more water and/or to pump the water to a higher level, as opposed to primarily heating the water to a substantially higher temperature.

On the other hand, if the check valve 56 is moved so as to be closer to the inlet end of the tube 20a, a lesser volume of water overall would be drawn into the heat exchange chamber 34a and the section of tube 20a up to the check valve 56, so that a lesser volume of water delivered would be delivered on each pumping cycle, but at higher temperature.

Figure 6:
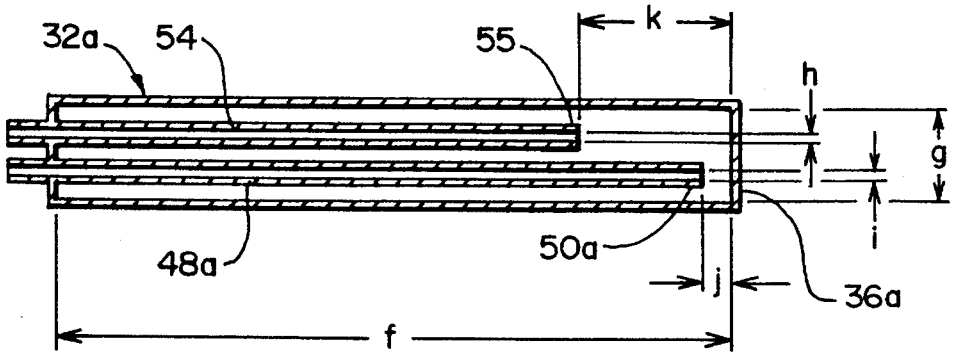
FIG. 6 is a view drawn to an enlarged scale showing the heat exchanger/pump of the second and third embodiments of FIGS. 4 and 5, and also showing dimensions of the same.

With reference to FIG. 6, the total lengthwise dimension "f" of the container 32a in a preferred embodiment was twenty four inches. The inside diameter "g" was one inch. The inside diameters of the conduits 54 and 48a, indicated at "h" and "i", respectively, were both 9/32 inch. The distance "j" from the end 50 of the conduit 48a to the end wall 36a was one inch. The distance "k" from the exit end 55 of the inner conduit 54 to the end wall 36*a* was four inches.

Figure 5:
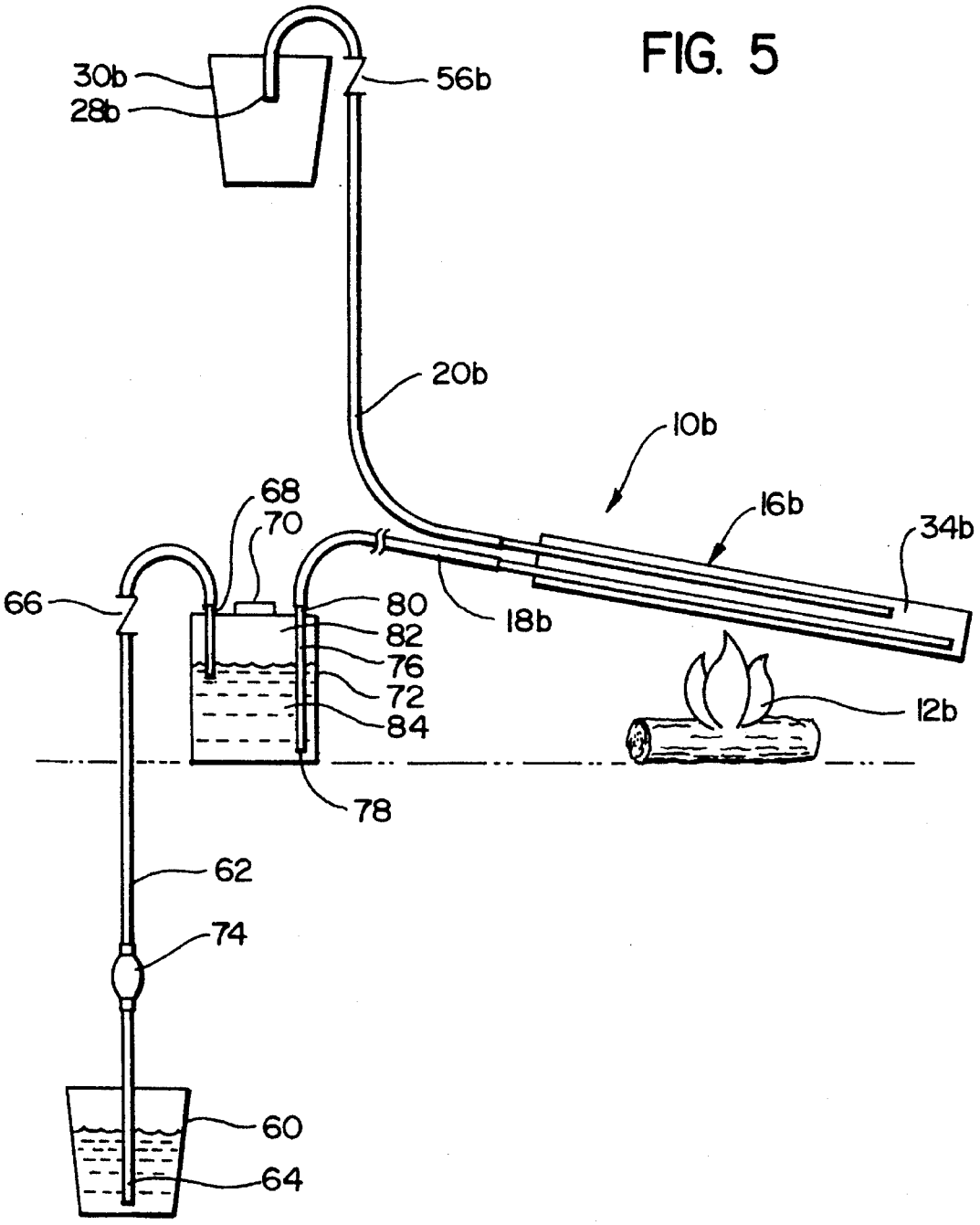
FIG. 5 is a view similar to FIGS. 1 and 4, showing yet a third embodiment of the present invention, where water is being drawn from a supply source at a lower location up to a using location, to be moved through a heat exchanger and then to a higher storage elevation.

A third embodiment of the present invention is shown in FIG. 5. Components of this third embodiment which are similar to the components of the prior two embodiments will be given like numerical designations with a "b" suffix distinguishing those of the third embodiment.

To describe the proposed application of this third embodiment, let it be assumed that the campsite where the apparatus 10*b* is to be used, is of a more permanent nature, such as a hunting campsite set up for a number of days, or possibly even a summer cabin. Let it further be assumed that there is a source of water nearby, but at a lower level, and that it is desired to bring water up to the living area of the campsite or cabin, and also to keep a fresh supply of water in an elevated storage container so that this could be delivered under pressure to the campsite or recreational cabin at a later time. This third embodiment is intended for use in this situation.

As in the prior embodiments, there is a heat exchanger/pump 16*b*, a supply hose 18*b* and a delivery hose 20*b*. The heat exchanger/pump 16*b* is the same as the heat exchanger/pump 16*a* of the second embodiment, and there is check valve 56*b* at the upper end of the delivery tube 20*b*. The elevated storage container is indicated at 30*b*.

The water supply is simply indicated at 60, and this could be, for example, a nearby stream, lake, or other source. For convenience this is shown simply as a container 60. A tube or hose 62 has its lower end 64 immersed in the water source 60, and it extends upwardly through a one way valve 66 (i.e. a selectively operable check valve) to a tube section 68 that extends through an upper lid 70 of a sealed pressure tank 72.

Desirably there is operatively positioned in the hose 62 a primer pump 74 similar in construction to the aforementioned siphon pump 22, and this can be operated to pump water upwardly through the tube 62, through the pipe section 68, and into the interior of the sealed pressure tank 72. The primer pump 74 would have check valves in it, so if this primer pump 74 is used, the check valve 66 would not be needed. Also, there is an outlet tube section 76 having an inlet end 78 opening to a lower portion of the tank 72, and the upper end 80 of this tube section 78 is connected to the supply hose 18*b*.

To operate this system, the primer pump 74 is operated to move water from the source 60 upwardly into the tank 72. Initially the lid 70 is either removed or left loose so that the tank 72 is not air tight. Then when the water that has been pumped from the source 60 into the tank 72 reaches a certain level, the lid 70 is properly secured to the tank 72 to make it air tight. The reason for this is that during the operation of this apparatus 10*b*, at a certain time there will be back flow into the tank 72 to raise the water level to cause above atmospheric pressure in the air space 82 above the water 84 in the tank 72, and at another time during the cycle the level of the water 84 will have dropped to cause the pressure in the air space 82 to be below atmospheric. The level of this water 84 at atmospheric pressure in the space 82 will be selected in accordance with certain operating parameters, such as the difference in elevation between the tank 72 and the water source 60, the volume of water to be pumped during each cycle, and other factors.

With the lid 70 fastened securely in the air tight position, as pressure increases in the air space 82 above the water 84 in the tank 72, water will be forced into the tube 76 to flow through the supply tube 18 and into the heating chamber 34*b* of the heat exchanger/pump 16*b*. The pump 74 is continued to be operated until the chamber 34*b* is filled.

With this being accomplished, then the heating and pumping cycle in the heat exchanger/pump 16*b* begins as described previously herein with respect to the second embodiment. More specifically, the heat exchanger/pump 16*b* is placed in or over the campfire 12*b*, and as the water in the chamber 34*b* reaches the boiling point, the water in the chamber 34*b* is forced upwardly in the delivery tube 20*b* and into the storage container 30*b*. Also this pressure increase in the chamber 34*b* causes some backflow in the tube 18*b* back to the tank 72 to raise the water level in the tank 72, thus increasing the pressure in the air space 82. When the out-flow of water from the chamber 34*b* causes the water in the chamber 34*b* to reach a sufficiently low level, steam then flows upwardly through the delivery tube 20*b* and is discharged out the tube end 28*b*. At this time, the pressure in the chamber 34*b* begins to drop toward atmospheric pressure, and the above atmospheric pressure in the air space 82 in the pressure tank 72 forces water through the tube 18*b* and into the chamber 34*b*. This immediately causes the steam in the chamber 34*b* to condense, causing the pressure in the chamber 34*b* to drop well below atmospheric pressure. This causes a further flow of water 84 from the tank 72 through the line 18*b* into and through the chamber 34*b*, and this lowers the level of the water 84 to lower the pressure in the airspace 82. When the pressure in the air space 82 drops to a sufficiently low level so that it is far enough below atmospheric pressure to exceed the pressure differential from the level of the water 60 to the level of the water 84 in the pressure container 72, water will begin to be drawn from the source 60 upwardly through the tube 62 and into the tank 72 which at present has its interior below atmospheric pressure.

This flow into the tank 72 from the water source 60 continues, while at the same time water is flowing out of the tank 72 through the tube section 76 and the supply tube 18*b* to supply water to the chamber 34*b* and into the delivery tube 20*b* until the pressure in the system is equalized. The new supply of water in the chamber 34*b* continues to be heated, and as it reaches the boiling point, steam is developed in the chamber 16*b*, and the cycle is repeated.

It will be noted that in this third embodiment, there is not a check valve in the line 18*b*. Accordingly, as indicated above, the pressure developed in the chamber 34*b* has the effect of pushing water back through the supply tube 18*b* to raise the level of the water 84 in the pressure tank 72, and increase the pressure in the air space 82 in the tank 72. The pressure in the chamber 34*b* acts to move the water in the tube 20*b* upwardly and then into the storage container 30*b*. Then when the pressure in the chamber 34*b* drops below atmospheric pressure, this reduces the pressure in the tank 72 to draw water up from the source 60. It should also be noted that the water 84 in the tank 72 is in the line of flow from the source 60 to the heat exchanger/pump 16*b*, so the water 84 delivered from the container 72 to the chamber 34*b* is water sufficiently cool to condense the steam in the chamber 34*b* and the tube 20*b*.

This cycle keeps repeating itself, so that in each cycle a portion of water is drawn from the source 60 upwardly into the pressure chamber 72, from the pressure chamber 72 into the heat exchanger/pump chamber 16*b* and also into the tube 20*b*. Then as the water in the chamber 34*b* reaches the boiling point, the pumping action starts to move water up and into the upper container or tank 30*b*. When the water is discharged from the tube 20*b*, the pressure in the chamber 34*b* drops and the cycle continues.

Figure 7:
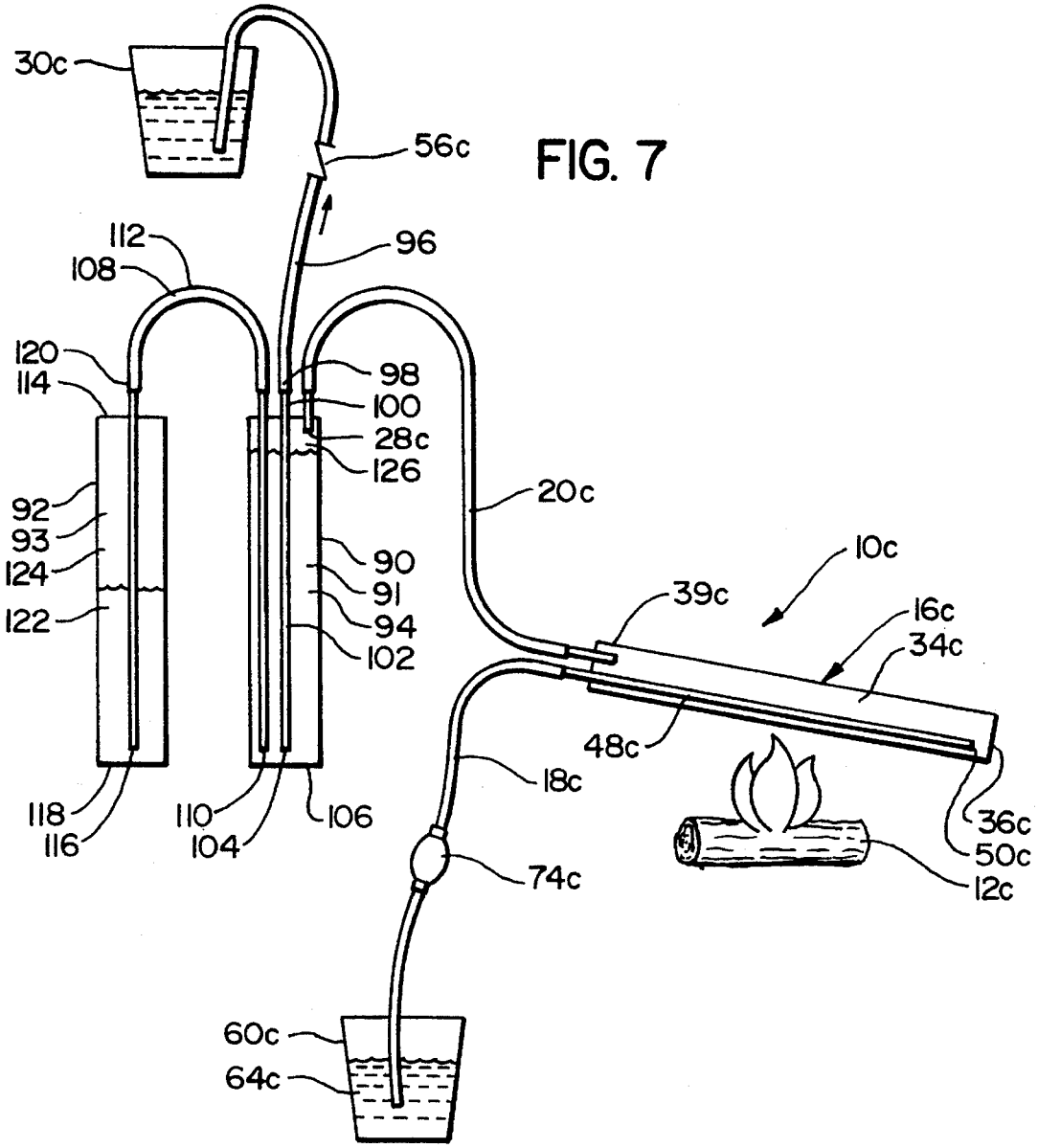
FIG. 7 shows yet a fourth embodiment that is particularly adapted to move larger quantities, relative to the heat energy used, to a higher storage location.

A fourth embodiment of the present invention is illustrated in FIG. 7. Components of this fourth embodiment which are similar to the components of the prior three embodiments will be given like numerical designations, with a "c" suffix distinguishing those of the fourth embodiment. As in the prior embodiments, the apparatus 10c comprises a heat exchanger/pump 16c having an inlet hose 18c and a delivery hose or tube 20c. There is a water source 60c which, as in the third embodiment, could be a nearby stream or lake, or possibly a well. A primer pump 74c is connected in the line 18c and is initially operated to draw the water 64c from the source 60c upwardly and inwardly into the chamber 34c.

The heat exchanger/pump 16c is, in physical configuration, more similar to the heat exchanger/pump 16 of the first embodiment of FIGS. 1 through 3. Thus, there is an elongate inlet tube 48c delivering the water through an end outlet 50c. However, the outlet pipe 20c has its inlet adjacent the near end 39c of the heat exchanger/pump 16c.

This fourth embodiment 10c is in some respects similar to the third embodiment of FIG. 5, in that water is drawn from a lower location, such as a stream or a lake and delivered to a higher storage location above the level of the heat exchanger/pump 16c. However, in terms of function, this fourth embodiment 10c differs from the third embodiment 10b in that it is arranged to pump large volumes of water, relative to the amount of heat energy delivered into the heat exchanger/pump 16c.

This fourth embodiment has a condensing/pump tank 90 having a chamber 91, and a pressure tank 92 with a chamber 93. The condensing/pump tank 90 is arranged to receive a relatively large volume of water 94 therein and at a later time discharge most all of this water 94 upwardly through a second delivery hose 96 through a check valve 56c to the delivery location 30c which would be an elevated storage tank 30c.

The pressure tank 92 is in some respects similar to the pressure tank 72 of the third embodiment, in that this tank 92 functions to deliver lower temperature water into the system at a certain point in the cycle to cause condensation of steam to occur in the condensing/pump tank 90, in the chamber 34c and in other locations. However, this pressure tank 92 is not positioned in an "in line" location in that it does not (as does the pressure tank 72 of the third embodiment) function to receive water directly from the water source 60c and deliver it through the line 18c into the pressure chamber 34c.

To describe the fourth embodiment in more detail, the first delivery line 20c has an outlet end 28c that extends a very short distance into the upper end of the condensing/pump tank 90. The second delivery tube 96 has its lower end 98 connected to the upper end 100 of an exit pipe 102 that extends downwardly into the tank 90, with its inlet end 104 being positioned just a short distance above the bottom wall 106 of the tank 90.

Connecting the interior of the condensing/pump tank 90 with the interior of the pump tank 92 is a tube or hose 108, having one end 110 thereof positioned in the tank 90 at the lower end thereof. This hose 108 extends upwardly from the opening 110 through an upper loop 112 and downwardly through the top sealed end 114 of the pressure tank 92. The other end 116 of this tube 108 is positioned just a short distance above the lower end 118 of the tank 92. Alternatively, the portion of the tube or hose 108 that is positioned within the pressure tank 92 could be made as a separate pipe that has a connection to the hose 108, as at the location 120.

To describe the operation of this fourth embodiment, initially the system 10c is primed with a supply of water. More specifically, the condensing/pump tank 90 is filled with water 94 nearly to the top. This could be done by removing the top of the tank 90, or through a supply valve. Also, the pressure tank 92 is filled with water 122 to a suitable level, so as to leave an adequate air space 124 above the level of the water 122. Then the bulb of the primer pump 74c is compressed and released a number of times so that the water 64c is pumped from the source 60c upwardly through the hose 18c and into the chamber 34c to substantially fill the chamber 34c.

With the system now being primed, the heat exchanger/pump 16c, with its chamber 34c filled with water, is placed in the heat source 12c, which could be a campfire, a fire in a fireplace, etc. As in the prior embodiments, when the water in the chamber 34c reaches the boiling point, the water in the chamber 34c will start to boil. Desirably, the heat exchanger/pump 16c is positioned at an angle so that its near end 39c is raised relative to its opposite end the end wall 36c. Thus, as steam is formed, there will be relatively less liquid water passing upwardly through the tube 20c, and a greater percentage of steam. As the pressure in the chamber 34 increases, the steam passing into the upper end of the chamber of the tank 90 pushes the level of the water 94 downwardly and forces the water upwardly into the pipe 102 and into the tube 96. With the primer pump 74c with its check valve positioned in the delivery hose 18c, there is no backflow into the hose 18c. As the water flows upwardly from the interior of the tank 90 up through the hose 96, there will be a rise in pressure in the space 126 above the water level in the tank 90. As this pressure in the space 126 increases, a certain amount of water 94 from the tank 90 will pass through the hose 108 and into the tank 92 to raise the level of the water 122, thus increasing pressure in air space 124 in the tank 92. This will continue until the pressure in the space 124 matches the peak back pressure from the water in the second delivery pipe 96.

Then as the steam continues to be generated in the chamber 34c to press the water 94 downwardly still further, this water 94 continues to flow through the second delivery tube 96 to be discharged into the storage tank 30c. When the water 94 in the tank 90 reaches the lower end 104 of the pipe 102, then steam starts to flow upwardly through the hose 96 until all the water in the tube 96 is discharged from the end of the tube 96, and steam begins to be discharged.

At this point there is an abrupt drop in pressure in the tube 96 and also within the tank 90, with this pressure drop also occurring in the chamber 34c. As soon as this happens, the pressure in the upper air space 124 in the tank 92 presses downwardly on the water 122 causing this water 122 to flow through the hose 108 and out the outlet 110 into the interior of the tank 90 to condense the steam in the interior of the tank 90. This causes the pressure in the chamber 90 to drop below atmospheric, so that yet more water 122 is pushed from the pressure tank 92 through the hose 108 into the interior of the tank 90, until the pressure in the air space 124 of the tank 92 drops far enough so as to match the below atmospheric pressure in the tank 90.

This drop in pressure of course causes a corresponding lowering in pressure within the chamber 34c so that it drops below atmospheric, and thus the atmospheric pressure imposed on the water 64c at the source 60c causes water to flow upwardly through the supply tube 18c into the chamber 34c, thence through the hose 20c to flow into the tank 90. This continued flow into the tank 90 results in water flowing into and upwardly through the pipe 102 and thence into the second delivery tube 96 to the location of the check valve 56c. Also, when the water level reaches the one open end 110 of the hose 108, water will flow through the hose 108 and into the interior of the pressure tank 92 to cause the level of the water 122 to rise.

When this cycle is completed and flow through the supply tube 18*c* and delivery tube 20*c* stops, the system will again be primed with a new supply of water. Then the water in the chamber 34*c* begins to be heated from the heat source 12*c* so that the cycle again repeats itself.

It can readily be appreciated that by making the volume of the chamber condensing/pump tank 90 substantially larger than the chamber 34*c* of the heat exchanger/pump 16*c* (possibly many times larger), a substantial volume of water (several times or many times greater than the volume of the chamber 34*c* can be pumped through the chamber 91 of the tank 90 to the elevated storage tank 30*c*. Thus, on each pumping cycle, it is necessary only to bring enough water into the chamber 34*c* to the boiling point to create enough steam to cause the pumping action of this substantially greater volume of water in the chamber 91 of the tank 90.

Figure 8:
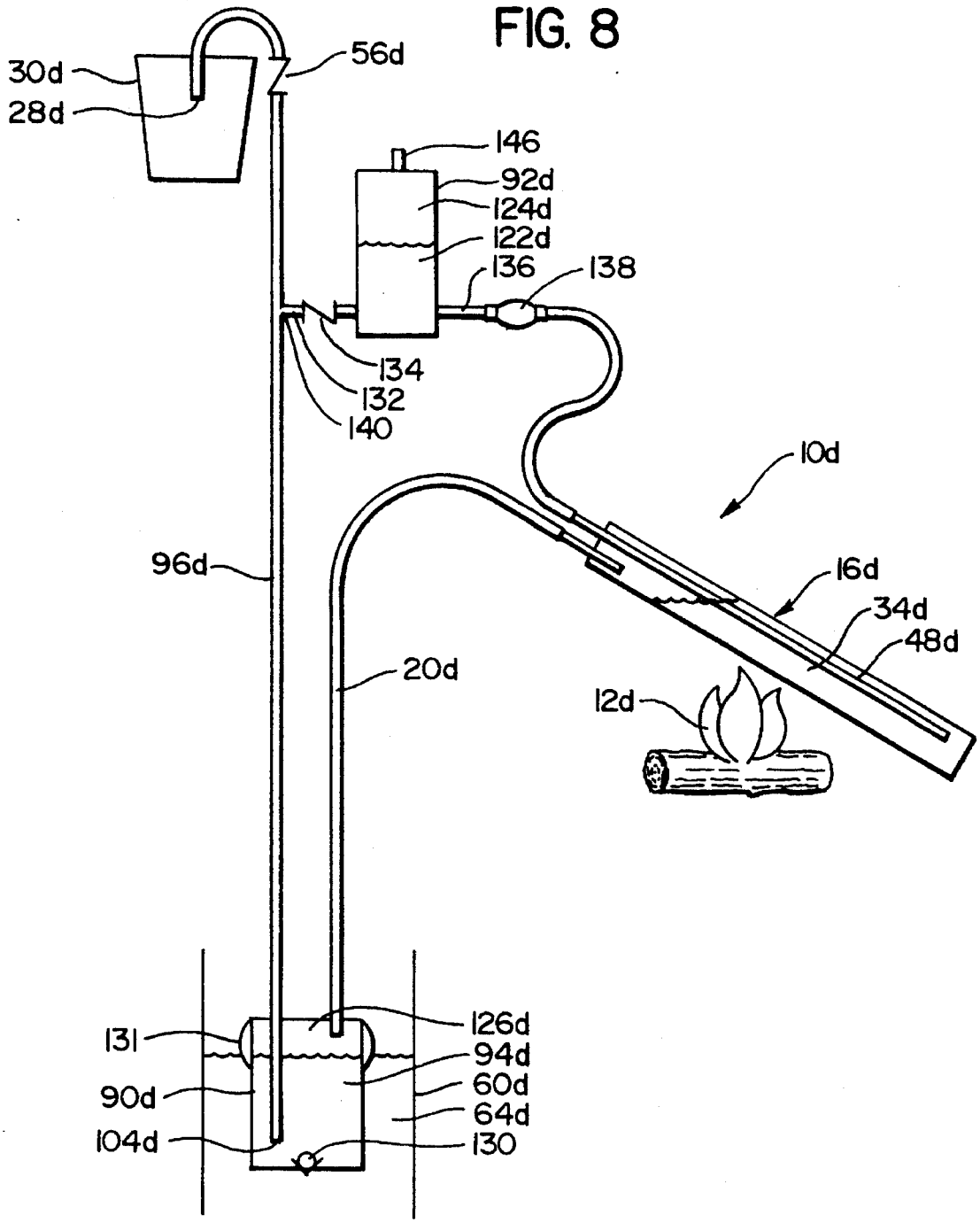
FIG. 8 is a schematic drawing of the fifth embodiment of the present invention.

A fifth embodiment of the present invention is illustrated in FIG. 8. Components of this fifth embodiment which are similar to components of the prior embodiments will be given like numerical designations, with a "d" suffix distinguishing those of the fifth embodiment.

The general operation of this fifth embodiment 10*d* is similar to that of the fourth embodiment 10*c*, in that it takes water from a lower location and utilizes a tank which is pressurized from steam from the heat exchange/pump device to pump water in the tank to a higher storage location. Thus, there is a heat exchanger/pump 16*d* which is substantially the same as the heat exchanger/pump 16*c* of the fourth embodiment. Also, there is a water source 60*d*, which can be a well 60*d* supplying ground water 64*d*. However, instead of pumping water, as in the fourth embodiment, from the source 60*c* to the heat exchanger/pump device 16*c*, this ground water in the well flows by gravity through a check valve 130 into the pump tank 90*d*. This pump tank 90*d* has float collar 131 around the top portion of the tank 90*d* so that an air space 126*d* is provided in the upper part of the tank 90*d*. Also, this pump tank 90*d* differs from the tank 90 of the fourth embodiment in that this tank 90*d* does not function as a condensing tank.

The water 94*d* from the tank 90*d* is moved upwardly through a tube 96*d* through a check valve 56*d* and into a storage tank 30*d*. Also, there is a delivery tube 20*d* that delivers steam from the heat exchange/pump 16*d* downwardly into the upper area 126*d* of the tank 90*d*. In the event the level of the water in the well rises or falls periodically, the tubes 96*d* and 20*d* can be provided with flexible sections to allow for the same.

A pressure tank 92*d* is provided, but this tank 92*d* operates in a somewhat different manner than the tank 92 of the fourth embodiment. A first line 132 leads through a check valve 134 to a lower portion of the tank 92*d*. A second line 136 leads through a prime pump bulb 138 having a check valve, into the inlet tube 48*d* of the heat exchanger/pump 16*d*. It will be noted that the inlet end 140 of the tube 132 is connected to the tube 96*d* at a location moderately below the level of the check valve 56*d* and below the outlet end 28*d* of the tube 96*d*.

To describe the operation of this fifth embodiment, first the system is primed by filling the pressure tank 92*d* partly full of water and then later closing an inlet valve 146 at the tank 92*d*. A quantity of water either flows by gravity into the chamber 34*d* or the pump bulb 138 can be operated to deliver the water.

Then the heat exchanger/pump 16*d* is placed in the campfire or other heat source, to cause the water in the chamber 34*d* to reach the boiling point. Steam develops in the chamber 34*d*, and this passes downwardly through the delivery tube 20*d* to increase the pressure in the area 126*d* in the upper part of the tank 90*d*. The water 94*d* in the tank 90*d* is pushed upwardly through the tube 96*d* toward the check valve 56*d*. As this occurs, pressure in the chamber 34*d* increases as the pressure head in the tube 96*d* increases as the water rises therein. When the water in the tube 96*d* reaches the level of the inlet 140 of the tube 132, a certain portion of this water will flow into the tank 92*d* to raise the pressure in the air space 124*d* in the upper part of the tank 92*d*. The water continues to flow upwardly through the check valve 56*d* and to be discharged into the storage tank 30*d*.

This flow of water 94*d* from the tank 90*d* continues until the water level in the tank 90*d* reaches the very bottom end 104*d* of the tube 96*d*. When this happens, steam under pressure begins traveling upwardly through the pipe 96*d* to push the water in the pipe 96*d* upwardly and through the check valve 56*d*. As soon the water is pushed out the end 28*d* of the pipe 96*d*, the pressure within the tube 96*d* and also in the delivery tube 20*d* drops to atmospheric or near atmospheric, thus causing the pressure in the chamber 34*d* to drop to near atmospheric. The result is that the pressurized air in the space 124*d* pushing downwardly on the water 122*d* in the tank 92*d* causes a quantity of water to flow from the tank 92*d* through the tube 136 into the chamber 34*d*. The tank 92*d* is sized, relative to the volume of the chamber 34*d*, and relative to the height of the tank 92*d* in relationship to the top end of the hose 96*d* (which in turn determines the pressure level that the air in the space 124*d* reaches) so that the quantity of the water delivered from the tank 92*d* is sufficient to substantially fill the chamber 34*d*.

At the same time that the water is caused to flow from the tank 92*d* into the chamber 34*d*, the reduction of pressure below atmospheric of the space 126*d* In the tank 90*d* is sufficient to help suck in supply water 64*d* from the well 60*d* to fill the tank 90*d*. It is also possible at this time, depending upon the positioning of the tank 92 and the amount of pressure reduction caused by condensation in the chamber 34*d*, for the water to be drawn from the source 60*d* even partly upwardly through the tube 96*d*. Alternatively, the check valve 56*d* could be eliminated, and gravity flow alone would cause water in the well to flow through the valve 104*d* into the tank 90*d*. Obviously, other arrangements are possible, and it would be possible to have the water source below the height of the tank 90*d* and draw water by suction (caused by reduced pressure in the chamber 34*d*) to draw water into the tank 90*d*.

Thus, at the completion of the cycle, the system is again primed with water. The water in the chamber 34*d* again begins to boil, thus causing pressurized steam to move through the tube 20*d* to pump the water upwardly from the tank 90*d*. At the same time, as described previously, there will be a flow of a quantity of water 122*d* into the pressure tank 92*d* to supply the next charge of water into the chamber 34*d* on a yet subsequent cycle. In this manner, the cycle keeps repeating itself.

With the arrangement of this fifth embodiment of FIG. 8, the heat source (e.g. a campfire 12*d*) can be positioned at higher elevation where it would not be possible to draw water from the source 60*d* solely by suction. Also, depending on the capacity of the system to generate an adequately high pressure in the chamber 34*d*, the storage tank 30*d* could still be placed at a substantially higher level than that of campfire or other heat source 12*d*.

It is to recognized that various modifications could be made to the present invention without departing from the basic teachings thereof.

What is claimed:

1. A method of heating and delivering water by utilizing heat from a heat source, such as an open campfire or a fireplace, said method comprising:

a. providing at a supply location a source of water, which remains open to ambient atmospheric pressure such as a container of water, with said supply location being at a first supply elevation to create a supply pressure head relative to lower elevations;

b. providing a source of heat, such as a campfire or a fireplace fire, having heating location at a second elevation lower than said first elevation;

c. providing a heat exchange pumping and condensing device comprising:

i. an elongate housing having a length dimension substantially greater than a width dimension thereof, and defining a water heat exchange chamber of a predetermined volume, said housing having a first end and a second end, ii. a water inlet means and a water outlet means at the first end of the housing, iii. an inlet conduit located in said chamber and having a conduit inlet connected to the water inlet and a conduit outlet adjacent to the second end of the housing and opening into said chamber near the second end of the housing;

iv. said housing having a side wall extending substantially entirely along said length dimension, said side wall being constructed and arranged as a heat exchange surface to receive heat from said heat source, as a primary source of heat from said heat source for said device;

d. providing a supply tube having a supply tube outlet end connected to said chamber inlet and a supply tube inlet positioned to receive water from said source at substantially atmospheric pressure;

e. providing a delivery tube having a delivery inlet end connecting to the chamber outlet, and positioning an outlet end of said delivery tube at a delivery location to create a delivery pressure head, with the delivery tube having a maximum delivery elevation which is at least as high as said supply elevation, said outlet end being positioned and arranged to be at approximately ambient atmospheric pressure;

f. filling said chamber with water, and locating said heat exchange pumping and condensing device at said heating location to be heated by said source of heat;

g. applying heat from the heat source primarily to the side wall of the housing and heating the water in the chamber to a boiling temperature to create steam in said chamber, while substantially blocking any reverse flow of the water in the chamber toward the source of water, and creating steam pressure in said chamber to a level greater than said delivery pressure head to cause flow of the water from the chamber through the outlet means and the delivery tube to be discharged at the discharge location;

h. continuing the discharge of the water from the chamber through the delivery tube until the water in the delivery tube is substantially discharged from the delivery tube so as to lower the pressure in the delivery tube and in said chamber to a level below the supply pressure head created by the water at said source of water, thus causing water to flow from said source downwardly through the supply tube toward the chamber;

i. causing flow of water from the supply tube to flow into the chamber near the second end thereof to absorb heat from the heat exchange pumping device and condense steam in the chamber, with the steam in the chamber being substantially entirely condensed in said chamber to thus cause additional water to flow by gravity from said source into said chamber to substantially fill said chamber.

2. The method as recited in claim 1, wherein said liquid is delivered from said source of water by siphoning said liquid from said source of water to said chamber.

3. The method as recited in claim 2, wherein said method comprises utilizing check valve pump means to move liquid at least initially through said supply tube and to prevent reverse flow in said supply tube.

4. The method as recited in claim 1, wherein said chamber inlet is at a first end location in said chamber, and said chamber outlet is at a second end location in said chamber, whereby liquid from said source of water is delivered to said chamber at said first end location, and exits from said chamber at the second end location.

5. The method as recited in claim 1, wherein said chamber outlet means is located at the first end location of the chamber so that outflow of water is at said first end location.

6. The method as recited in claim 1, wherein there is a second delivery conduit positioned within and extending lengthwise in said chamber and having an inlet end adjacent to the second end of the container and an outlet end connecting to the chamber outlet.

7. The method as recited in claim 1, wherein said method comprises utilizing check valve pump means to move liquid at least initially through said supply tube and to prevent reverse flow in said supply tube.

8. The method as recited in claim 1, wherein said heat exchange pumping and condensing device is located at the heating location in a manner that the second end of the elongate housing is lower than the first end, whereby water flowing from said inlet conduit initially remains at a limited region at the second end of the housing to enhance proper condensation while permitting substantially uninterrupted flow of water through said inlet conduit.

9. An apparatus to provide hot water from a heat source, such as a campfire or a fireplace, where a combustible material, such s wood or the like, is being burned, said apparatus comprising:

a. a heat exchange pumping and condensing device comprising i. an elongate housing having a length dimension substantially greater than a width dimension thereof, and defining a water heat exchange chamber of a predetermined volume, said housing having a first end and a second end, ii. a water inlet means and a water outlet means at the first end of the housing, iii. an inlet conduit located in said chamber and having a conduit inlet connected to the water inlet and a conduit outlet adjacent to the second end of the housing, and opening into said chamber near the second end of the housing;

iv. said housing having a side wall extending substantially entirely along said length dimension, said side wall being constructed and arranged as a heat exchange surface to receive heat from said heat source, as a primary source of heat from said heat source for said device;

b. a supply tube having a first end adapted to be in communication with a supply source of water and an outlet end connected to the inlet of said device, c. a check valve operatively connected in said supply tube to permit flow of water from said supply source through said supply tube means into said chamber d. a delivery tube having one end connected to the outlet of said device, and a second end adapted to be positioned at a delivery location;

e. said apparatus being configured and arranged so that with the supply tube and the delivery tube being connected to the housing, the device can be placed in the heat source where a major part of the housing can be positioned in a high heat area of said heat source, while the first end of the device can be spaced from said high heat area so that the supply tube and the delivery tube are exposed to a lower level of heat;

g. said apparatus being characterized in that the predetermined volume is such, relative to a heat exchange surface area of said containing section and the thermal conductivity of the containing section, that sufficient heat is created to generate steam in said chamber to increase pressure in said chamber to cause flow of water from said chamber through said delivery tube and out said delivery tube at said delivery location, and then create a reduced pressure in said chamber to cause a flow of water from said supply location through said supply tube into said chamber, where additional water in said chamber is again heated to deliver a quantity of water through said delivery tube.

10. The apparatus as recited in claim 9, wherein there is check valve means operably connected to said delivery tube to prevent reverse flow through said delivery tube back to said chamber.

11. The apparatus as recited in claim 10, wherein there is an outlet conduit positioned in said chamber, said outlet conduit having an inlet end adjacent to the second end of the housing and an outlet end connected to the water outlet means of the housing, said housing being configured and arranged so that it can be placed in the heat source with the second end of the housing at a lower elevation than the first end of the housing, whereby when water in the housing has been heated and discharged through the delivery tube, then additional water flows from the supply tube, through the supply conduit and into the chamber at the second end of the housing, and then progressively fills the rest of the chamber toward the first end, after which the water then in the housing is heated to create steam at the first end, and water is discharged from the chamber into the inlet end of the outlet conduit at the second end of the housing.

12. The apparatus as recited in claim 9, wherein there is an outlet conduit positioned in said chamber, said outlet conduit having an inlet end adjacent to the second end of the housing and an outlet end connected to the water outlet means of the housing, said housing being configured and arranged so that it can be placed in the heat source with the second end of the housing at a lower elevation than the first end of the housing, whereby when water in the housing has been heated and discharged through the delivery tube, then additional water flows from the supply tube, through the supply conduit and into the chamber at the second end of the housing, and then progressively fills the rest of the chamber toward the first end, after which the water then in the housing is heated to create steam at the first end, and water is discharged from the chamber into the inlet end of the outlet conduit at the second end of the housing.

13. The apparatus as recited in claim 9, wherein there is a manually operated pump operatively connected to said supply tube so that water can be pumped through the supply tube and through the chamber.

* * * * *